United States Patent [19]

Jackson et al.

[11] Patent Number: 4,987,675

[45] Date of Patent: Jan. 29, 1991

[54] METHOD OF MANUFACTURING COILED HEATING ELEMENT

[75] Inventors: James D. J. Jackson, Kidderminster; Derek E. Morgan, Malvern, both of United Kingdom

[73] Assignee: Micropore International Limited, Worchestershire, United Kingdom

[21] Appl. No.: 224,005

[22] Filed: Jul. 25, 1988

[30] Foreign Application Priority Data

Jul. 25, 1987 [GB] United Kingdom ..... 8717668

[51] Int. Cl.[5] ..... H01C 1/03

[52] U.S. Cl. ..... 29/615; 29/616; 29/446; 219/546; 219/552; 219/553; 338/296; 338/333

[58] Field of Search ..... 219/546, 552, 553; 338/296, 333; 29/611, 614, 615, 616, 446

[56] References Cited

U.S. PATENT DOCUMENTS

| | | | |
|---|---|---|---|
| 1,433,691 | 10/1922 | Woodson | 29/614 X |
| 1,793,829 | 2/1931 | Richardson et al. | 29/615 X |
| 1,997,844 | 4/1935 | Wiegand | 29/614 |
| 2,375,058 | 5/1945 | Weigand . | |
| 2,577,080 | 12/1951 | Glenn | 29/614 |
| 2,853,765 | 9/1958 | Wemhoener | 29/615 |
| 3,622,935 | 6/1970 | Oakley . | |

FOREIGN PATENT DOCUMENTS

| | | |
|---|---|---|
| 636889 | 10/1936 | Fed. Rep. of Germany . |
| 4460172 | 12/1974 | Fed. Rep. of Germany . |
| 2087698 | 3/1984 | United Kingdom . |
| 2197169 | 5/1988 | United Kingdom . |

*Primary Examiner*—Mark Rosenbaum
*Assistant Examiner*—Frances Chin
*Attorney, Agent, or Firm*—Browdy and Neimark

[57] ABSTRACT

A coiled heating element is manufactured by providing a coiled element of bare resistance wire in which the coil pitch is not greater than twice the cross-sectional dimension of the wire. The element is stretched by an amount permitting recovery to its original configuration and an electrically insulating particulate material is applied to the stretched element. The stretched element is then allowed to return towards its original configuration thus trapping particulate material between adjacent coils of the element and the element is heated so as to oxidize the surface of the wire.

15 Claims, 2 Drawing Sheets

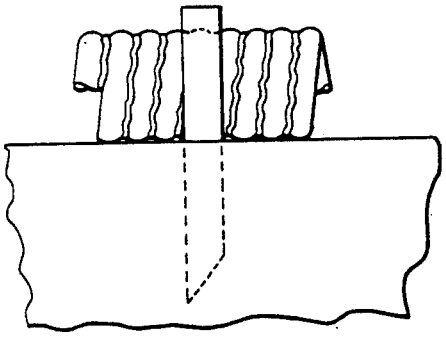
FIG 4
FIG 5
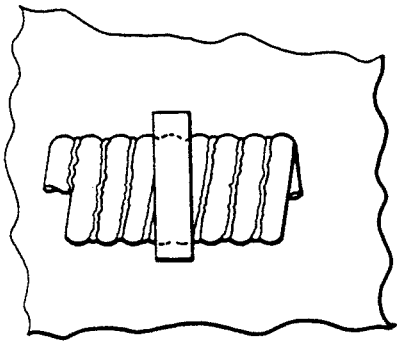

METHOD OF MANUFACTURING COILED HEATING ELEMENT

FIELD OF THE INVENTION

The present invention relates to the manufacture of coiled heating elements and more particularly but not exclusively relates to the manufacture of coiled heating elements in which adjacent coils of the heating element are in contact with each other or are at least very close to each other. The invention also relates to electric heaters incorporating such heating elements.

DESCRIPTION OF PRIOR ART

Coiled heating elements (so-called close coiled heating elements) in which adjacent coils of the heating element are in contact with each other or are very close to each other are known. It is also known that electrical insulation between adjacent coils is important because inadequate insulation can lead to short circuits and uneven heating of the element. When using such elements in heaters for glass ceramic top cookers any short circuited regions can be seen through the glass ceramic cooking surface as dark areas which may be several centimeters long. This makes such close coiled heating elements unsightly and inefficient and can reduce their working life.

It is usual to insulate adjacent coils of the heating element by oxidizing the wire to produce a thin oxide scale on the surface thereof. However, oxidized the wire presents a number of problems because the wire requires to be heated to a temperature of the order of 1100° to 1200° C. in order to produce sufficient oxide scale in a reasonably short time. If the wire is oxidized with adjacent coils of the heating element in contact with each other welding can occur at the points of contact so that short circuited regions can still arise. If the heating element is stretched to separate adjacent coils, the heat treatment causes the wire to be annealed and to lose its previous resilience. This would require a further manufacturing stage to return the heating element substantially to its original configuration, assuming such an operation is even feasible.

OBJECT OF THE INVENTION

It is an object of the present invention to provide an improved method of manufacturing a heating element in which the adjacent coils are at least very close to each other.

SUMMARY OF THE INVENTION

According to the present invention there is provided a method of manufacturing a coiled heating element, which method comprises the steps of:

providing an unsheathed coiled element of bare resistance wire in which the coil pitch is not greater than twice the cross-sectional dimension of the wire;

stretching the element by an amount permitting recovery to its original configuration;

applying to the element an electrically insulating particulate material;

allowing the stretched element to return towards its original configuration thereby trapping particulate material between adjacent coils of the element; and heating the element so as to oxidize the surface of the wire.

The particulate material may be an oxide such as aluminium oxide or magnesium oxide or may be a refractory clay such as china clay.

The particle size may be less than the cross-sectional dimension of the wire and is preferably less than one tenth of the cross-sectional dimension of the wire.

The particle size of the particulate material may be from 30 to 50 microns.

The particulate material may be applied to the element by dipping or spraying. The particulate material may be in the form of a dry powder or a slurry.

The element is preferably heated to a temperature from 1100° to 1200° C. The heating may be effected by placing the element in a furnace or by passing an electric current through the element.

For a better understanding of the present invention and to show more clearly how it may be carried into effect reference will now be made, by away of example, to the accompanying drawings in which:

BRIEF DESCRIPTION OF THE DRAWINGS

FIG. 4 is a partial cross-sectional view of a heating element according to the present invention stapled to a base; and FIG. 5 is a partial plan view corresponding to the view shown in FIG. 4.

DESCRIPTION OF PREFERRED EMBODIMENT

Figure 1:
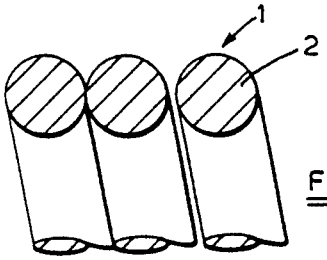
FIG. 1 shows a part of a coiled heating element as produced by a coil winding machine.

When a coiled heating element 1 of bare resistance wire 2 is wound on a coil winding machine, adjacent coils of the element are close to each other as shown in FIG. 1 and are often in contact. It has previously been the practice to stretch such elements so that adjacent coils are well spaced and to secure the stretched elements to a base of thermally and electrically insulating material, for example by inserting staples between adjacent coils.

Figure 2:
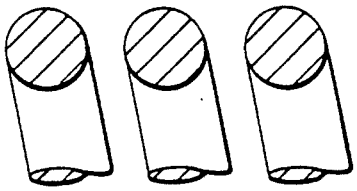
FIG. 2 shows the coiled heating element stretched so as to separate adjacent coils.

In accordance with the present invention the coiled heating element 1 is stretched as shown in FIG. 2 so as to separate adjacent coils of the element. It is important not to stretch the element beyond the limits of its natural resilience so that the coils are able to return substantially to their original configuration.

An electrically insulating particulate material is then applied to the element, for example by dipping the element 1 into a dry powder or an aqueous slurry. However, other methods such as spraying the material, for example by electrostatic spraying, can be used. The particulate material can be any powder which is electrically insulating at elevated temperatures. Suitable materials include oxides such as aluminium oxide and magnesium oxide and refractory clays such as china clay. We have found that some bonding may occur between the wire and the particulate material, for example in the case of magnesium oxide powder and iron-chromium-aluminium resistance wire. This is advantageous in that it provides additional insulating characteristics.

The particle size of the particulate material must not be too large so as to avoid excessive stretching of the element. The particles should generally be smaller than the wire diameter and preferably should not be larger than one tenth of the wire diameter. The particle size for commonly used wire diameters is typically from 30 to 50 microns.

The degree of stretch required in the element before the application of the particulate material will depend on the particular dimensions of the wire, the coil and the particulate material. However, the degree of stretch can readily be established in each case by simple tests.

Figure 3:
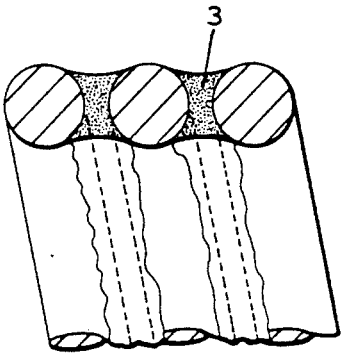
FIG. 3 shows the heating element relaxed but with particulate material trapped between adjacent coils.

The stretched element is allowed to return substantially to its original configuration thereby trapping particulate material 3 between adjacent coils of the element. We have found that sufficient particulate material becomes trapped between adjacent coils to provide adequate electrical insulation between the coils to prevent short circuits. It is not necessary to ensure complete coverage of the wire with the particulate material because the element is heated so as to oxidize the surface of the wire and any exposed portions will therefore form an electrically insulating layer. The heating of the element to oxidize the surface of the wire is preferably carried out at a temperature of about 1100° to 1200° C. Heating can be effected for example by placing the element in a furnace or by passing an electric current through the element. This results in the heating element shown in FIG. 3.

We have found that the method of the present invention reliably ensures the elimination of short circuits between adjacent coils of the heating element. The heating element can be incorporated into a heater for a glass ceramic top cooker by disposing the element on a base layer of thermal and electrical insulating material, such as a microporous insulating material. The general arrangement may be as shown in GB-A No. 2 087 698. However, in the arrangement shown therein the element is secured by staples located between individual coils of the element. The substitution of a heating element made according to the present invention enables the use of staples which straddle the top of the heating element, as shown in FIGS. 4 and 5, without risk of deformation such as could occur with more widely spaced coils. This is because the adjacent coils and insulating powder of the heating element made by the method of the present invention are self-supporting. It is therefore immaterial at what point along the heating element the staple is applied, and in particular there is no need to aim the staples between adjacent coils of the heating element as shown in GB-A No. 2 087 698. This positional flexibility in turn facilitates automation of the stapling operation. As an alternative to the use of staples, the heating element can be employed in conjunction with the technique of gluing coils for example to stakes as described in GB-A No. 2 197 169.

We claim:

1. A method of manufacturing a coiled heating element, which method comprises the steps of:

providing an unsheathed coiled element of bare resistance wire, the wire having a cross-sectional dimension and a surface, and the coiled element having a coil pitch not greater than twice the cross-sectional dimension of the wire;

stretching the element by an amount permitting recovery to its original configuration;

applying to the element an electrically insulating particulate material;

allowing the stretched element to return towards its original configuration thereby trapping particulate material between adjacent coils of the element; and heating the element so as to oxidize the surface of the wire.

2. A method according to claim 1, wherein the particulate material is an oxide.

3. A method according to claim 2, wherein the particulate material is selected from the group consisting of aluminium oxide and magnesium oxide.

4. A method according to claim 1, wherein the particulate material is a refractory clay.

5. A method according to claim 4, wherein the particulate material comprises china clay.

6. A method according to claim 1, wherein the particle size is less than the cross-sectional dimension of the wire.

7. A method according to claim 6, wherein the particle size is less than one tenth of the cross-sectional dimension of the wire.

8. A method according to claim 1, wherein the particle size of the particulate material is from 30 to 50 microns.

9. A method according to claim 1, wherein the particulate material is applied to the element by dipping.

10. A method according to claim 1, wherein the particulate material is applied to the element by spraying.

11. A method according to claim 1, wherein the particulate material is in the form of a dry powder.

12. A method according to claim 1, wherein the particulate material is in the form of a slurry.

13. A method according to claim 1, wherein the element is heated to a temperature of 1100° to 1200° C.

14. A method according to claim 1, wherein the heating is effected by placing the element in a furnace.

15. A method according to claim 1, wherein the heating is effected by passing an electric current through the element.

* * * * *